US008553914B2

(12) United States Patent
Fletcher

(10) Patent No.: US 8,553,914 B2
(45) Date of Patent: Oct. 8, 2013

(54) APPARATUS FOR REPRODUCTION OF STEREO SOUND

(75) Inventor: Edward Stuart Fletcher, Torquay (GB)

(73) Assignee: Airsound LLP, Torquay (GB)

( * ) Notice: Subject to any disclaimer, the term of this patent is extended or adjusted under 35 U.S.C. 154(b) by 888 days.

(21) Appl. No.: 12/440,017

(22) PCT Filed: Aug. 21, 2007

(86) PCT No.: PCT/GB2007/003191

§ 371 (c)(1),
(2), (4) Date: Nov. 23, 2009

(87) PCT Pub. No.: WO2008/023167

PCT Pub. Date: Feb. 28, 2008

(65) Prior Publication Data

US 2010/0061575 A1 Mar. 11, 2010

(30) Foreign Application Priority Data

Aug. 25, 2006 (GB) ..... 0616910.6
Sep. 25, 2006 (GB) ..... 0618854.4

(51) Int. Cl.
*H04R 5/02* (2006.01)

(52) U.S. Cl.
USPC ..... 381/305; 381/300; 381/308

(58) Field of Classification Search
USPC ..... 381/300, 304, 305, 308, 89
See application file for complete search history.

(56) References Cited

U.S. PATENT DOCUMENTS 3,588,355 A 6/1971 Holm
4,714,133 A * 12/1987 Skaggs, Jr. ..... 181/160
5,027,403 A * 6/1991 Short et al. ..... 381/306
5,386,473 A * 1/1995 Harrison ..... 381/306
5,809,153 A * 9/1998 Aylward et al. ..... 381/337
6,367,579 B1 * 4/2002 Wiener ..... 181/199
6,721,431 B1 * 4/2004 Johnson ..... 381/336
2003/0016830 A1 1/2003 Nakamichi
2005/0047617 A1 * 3/2005 Lee ..... 381/306

FOREIGN PATENT DOCUMENTS

AU 658020 3/1995
EP 0069864 1/1983
EP 0383535 8/1990
WO 98/42159 A1 9/1998

OTHER PUBLICATIONS

International Search Report,—PCT/GB2007/003191, Dec. 21, 2007.

* cited by examiner

*Primary Examiner* — Disler Paul
(74) *Attorney, Agent, or Firm* — Kilpatrick Townsend & Stockton LLP

(57) ABSTRACT

Apparatus for reproducing stereo sound having a housing (1, 25) defining an at least partially enclosed space. A first transducer (7) or pair of transducers (28, 29) is provided and arranged to reproduce one, both or the sum of two audio signals. A pair of transducers (10, 32) is also provided and arranged to reproduce a signal comprising the difference of the two audio signals. As the transducers communicate with the at least partially enclosed space, and the transducers arranged to reproduce the difference between the two audio signals are each arranged to direct their output primarily in a direction generally at right angles to the direction in which the first transducer or pair of transducers primarily direct their output. The apparatus may be arranged to be placed on or adjacent a generally flat surface, and the transducers arranged to reproduce the difference of the two audio signals may be arranged to direct their output towards the flat surface.

24 Claims, 5 Drawing Sheets

APPARATUS FOR REPRODUCTION OF STEREO SOUND

CROSS-REFERENCES TO RELATED APPLICATIONS

This application claims priority to PCT GB2007/003191, filed Aug. 21, 2007,which claims priority to GB Application No. 0616910.6, filed Aug. 25, 2006, and GB Application No. 0618854.4, filed Sep. 25, 2006, commonly assigned, and all of which is hereby incorporated by reference for all purposes.

STATEMENT AS TO RIGHTS TO INVENTIONS MADE UNDER FEDERALLY SPONSORED RESEARCH OR DEVELOPMENT

NOT APPLICABLE

REFERENCE TO A "SEQUENCE LISTING," A TABLE, OR A COMPUTER PROGRAM LISTING APPENDIX SUBMITTED ON A COMPACT DISK

NOT APPLICABLE

BACKGROUND OF THE INVENTION

The present invention relates to apparatus for reproducing stereo sound, and particularly to apparatus for reproduction of stereo sound from a two channel stereo sound signal.

Stereo sound recording and reproduction employs stereographic projection to encode the relative position of sound sources recorded, and aims to reproduce the sound with a sense of those relative positions. A stereo system can involve two or more channels, but two channels systems dominate for audio recording. The two channels (usually known as left and right) convey information relating to the sound field in front of the listener. By far the most popular means for reproducing two channel stereo signals is to broadcast the channels via two respective, spaced apart, left and right loudspeakers.

Despite its popularity, though, there are disadvantages with this system. Most commercial two channel stereo sound recordings are mixed for optimum reproduction by loudspeakers spaced about 1.6 meters apart. In reality, this is rarely possible, especially where it is desired to reproduce stereo sound from a single unit. In any event, however a recording is mixed, the closer the loudspeakers used to transmit the left and right channels are together, the poorer the stereo effect reproduced.

Also, for optimum perception of stereo effect the listener should be located at the apex of an equilateral triangle made by the pair of loudspeakers and the listener. In reality, though, it is often inconvenient or impossible for a listener to adopt or maintain this position and, of course, it is impossible for multiple listeners to listen from the same position.

An alternative system for reproduction of a two channel stereo signal which should overcome some of the above disadvantages has been proposed. This system, which shall be referred to as the sum and difference system, is disclosed in U.S. Pat. No. 3,588,355. This document discloses a stereophonic loudspeaker system comprising two pairs of loudspeakers. Each pair is oriented with their axes at right angles to each other and substantially equidistant from the point of intersection of the axes. The speakers are so arranged that one speaker of each pair faces the listener and the other speaker has its axis substantially perpendicular to the listener. Means are provided for matrixing left and right two-channel stereo signals to provide a sum signal and a difference signal. The sum signals are applied in phase to the speakers whose axes are directed toward the listener, and the difference signals are applied to the speakers whose axes are positioned at right angles with respect to the direction of the listener, the difference signals to the two perpendicular speakers being applied 180° out of phase with each other:—As a result, a stereophonic sound effect should be produced by the system.

Whilst intended to overcome the problems associated with the use of spaced apart speakers the arrangement of U.S. Pat. No. 3,588,355 has not entered widespread use. This is thought to be because there are practical difficulties with the disclosed apparatus which result in the actual sound quality and perceived stereo effect obtained falling below what might theoretically be expected.

The present invention seeks to provide improved apparatus for the reproduction of stereo sound.

According to a first aspect of the invention there is provided apparatus for reproduction of stereo sound comprising a first transducer arranged to reproduce one of two audio signals and a second transducer arranged to reproduce the other signal, and one or two further transducers arranged to reproduce a signal comprising the difference of the two audio signals.

This arrangement combines advantages of conventional two speaker systems for reproduction of stereo sound, and the sum and difference system. Appropriately directed difference signals can be employed to enhance the perceived width and depth of the signal reproduced. This is useful where the perceived width and depth of the signal reproduced by the first and second transducers alone is limited. This is the case where two transducers are arranged close together, for example in the same housing in portable stereo reproduction equipment.

The apparatus may comprise a housing defining an at least partially enclosed space. All the transducers may be mounted in the housing, and may all communicate with the partially enclosed space; The first and second transducers are preferably arranged to direct their output in substantially parallel, spaced apart directions. The two transducers arranged to reproduce the difference of the two signals are preferably arranged to direct their output primarily in a direction generally at right angles to the direction in which the first and second transducers are arranged to primarily direct its output, and may direct their output in generally opposite directions.

According to a second aspect of the present invention there is provided apparatus for reproduction of stereo sound comprising a housing defining an at least partially enclosed space, a first transducer arranged to reproduce one, or the sum, of two audio signals and two transducers each arranged to reproduce a signal comprising the difference of the two audio signals, wherein the three transducers all communicate with the at least partially enclosed space and wherein the transducers arranged to reproduce the signal comprising the difference of the audio two signals are each arranged to direct their output primarily in a direction generally at right angles to the direction in which the first transducer is arranged to primarily direct its output.

Where the first transducer is arranged to reproduce one of two audio signals a second transducer is preferably provided to reproduce the other signal, and the first and second transducers are preferably arranged to direct their output in substantially parallel, spaced apart directions.

It is thought that the sum and difference system of stereo sound reproduction works by the broadcast audio sum signal being modified by the broadcast difference signal by varying amounts at different locations to recreate the original recorded sound field, or an approximation of it. Where first and second transducers are provided to transmit respective audio signals a similar effect to broadcast of the sum of the two signals by one or more transducers is obtained, especially if the two transducers are close together. Having all three, or four as the case may be, transducers communicate with the same partially enclosed space confers two distinct benefits. Firstly it simplifies the mechanical construction of the apparatus, particularly the housing, there being no need to construct baffles or ports to separate the transducers. For given transducers this can reduce the overall size of housing required, and/or can allow mounting of other components in the housing. Likewise this may enable a pair of speakers arranged to transmit a difference signal to be incorporated into available space in the housing of existing mono or stereo audio equipment to enable the equipment to be redesigned to reproduce a stereo or improved stereo audio signal without the need to increase the size of the housing. Secondly, it provides for increased interaction between the output of the transducers which can add increased perceived depth and width to the sound reproduced by the apparatus.

According to a third aspect of the present invention there is provided apparatus for reproduction of stereo sound comprising a housing arranged to be placed on or adjacent a generally flat surface, a first transducer arranged to reproduce one, or the sum, of two audio signals and two transducers each arranged to reproduce a signal comprising the difference of the two audio signals, wherein the transducers arranged to reproduce the signal comprising the difference of the two audio signals are each arranged to direct their output primarily in a direction generally at right angles to the direction in which the first transducer is arranged to primarily direct its output and wherein the two transducers arranged to reproduce the signal comprising the difference of the two audio signals are arranged relative to the housing such that when the housing is placed on or adjacent a generally flat surface both transducers are oriented to direct their output primarily in a direction extending towards the plane of the surface.

By directing the output of the transducers reproducing the difference signal towards a surface against which the apparatus is used any surface effect caused by the surface, and which is generally found to improve the output of the apparatus, is enhanced.

Where the first transducer is arranged to reproduce one of two audio signals a second transducer is preferably provided to reproduce the other signal, and the first and second transducers are preferably arranged to direct their output in substantially parallel, spaced apart directions.

Apparatus according to any aspect of the invention may include any or all additional features of another aspect of the invention, as appropriate.

BRIEF SUMMARY OF THE INVENTION

The following relates to optional features of all aspects of the invention.

Each transducer may be a loudspeaker. The loudspeaker may comprise a driver arranged to drive a loudspeaker element, such as a diaphragm which may be of any suitable shape, for example frusto-conical, or substantially flat.

The two transducers arranged to reproduce a signal comprising the difference of two audio signals ("the difference signal") are preferably arranged to reproduce the signal substantially out of phase with respect to each other, and to direct the two out of phase signals in different, preferably generally opposite directions. The out of phase signals are preferably 180 degrees out of phase.

The housing preferably has two openings via which the two difference signals are transmitted. Where the housing is arranged to be placed on or adjacent a flat surface, the openings are preferably disposed on the housing such that when the housing is placed on or adjacent a flat surface, the openings lie adjacent that surface. The housing preferably includes at least one substantially flat surface. This may form the underside of the housing, enabling it to be placed on a flat surface, or a side of the housing, enabling it to be placed adjacent a flat surface, such as a wall. Alternatively, or additionally, the housing may comprise a flat surface or surfaces extending from adjacent the or each opening. Arranging so that the or each opening can lie adjacent a flat surface enables the surface effect to be exploited. As discussed further below, arranging for the difference signals to be broadcast along a flat surface enhances them, and consequently the overall sense of width and depth of the reproduced sound of a sum and difference system.

The housing may also include an opening via which the signal comprising the sum of two audio signals, where provided, is transmitted. Alternatively the housing may include one or two openings via which the audio signals are separately transmitted. The housing may further include an additional opening, forming a port which acts as a pressure relief valve to the at least partially enclosed space when lower frequencies are reproduced. The port may lead to a conduit or tube extending in the at least partial enclosure formed by the housing. The housing may be fully enclosed, save for provision of the port.

Where the two transducers arranged to reproduce the difference signal are oriented to direct their output primarily in a direction extending towards the plane of a generally flat surface or against which the housing is placed; the transducers are each preferably directed towards the surface at an angle of between 1 and 8 degrees to the surface, more preferably at an angle of between 2 and 6 degrees and still more preferably at an angle of between 3 and 5 degrees. Where the housing includes a substantially flat surface the transducers arranged to reproduce the difference signal may be oriented, as discussed above, relative to the plane of that surface which will correspond substantially to the plane of any substantially flat surface it is placed on or adjacent to.

The apparatus may be used to reproduce a two channel stereo signal using the sum and difference system. In this case the transducers for reproducing two out of phase difference signals are driven with a signal comprising and preferably consisting exclusively of the difference of the two stereo channels and the third transducer is driven with a signal comprising or consisting exclusively of the sum of the two stereo channels.

The apparatus may include a sum and difference matrix to achieve this.

Alternatively the apparatus may be used to reproduce a two channel stereo signal using a conventional arrangement of two spaced apart transducers, a respective transducer for each of the two stereo channels, supplemented by transducers for reproducing two out of phase difference signals driven with a signal comprising and preferably consisting exclusively of the difference of the two stereo channels.

In either case the difference signal may be filtered to reduce the amplitude of low frequencies. Low frequencies included in the sum signal or individual channels of the stereo signal used to drive two transducers may be boosted. The apparatus may include a high pass-filter and/or a bass lift compensation .circuit. It is found that boosting low frequencies transmitted by the transducer(s) which reproduces the sum, or individual components, of the two audio signals and reducing or eliminating low frequencies transmitted by the transducers which reproduce the difference signal leads to a further improvement in the depth and feel of the reproduced sound. This is also discussed further below.

The apparatus could be provided in a housing arranged to receive a device intended to provide a stereo signal to drive the transducers. In particular the device may be comprised in a docking station for an MP3 player or other portable music playing device. Alternatively the device could include a device or relevant components to produce a stereo signal to drive the transducers, for example a radio tuner.

BRIEF DESCRIPTION OF THE DRAWINGS

In order that the invention may be more clearly understood embodiments thereof will now be described, by way of example, with reference to the accompanying drawings of which.

DETAILED DESCRIPTION OF THE INVENTION

Figure 1:
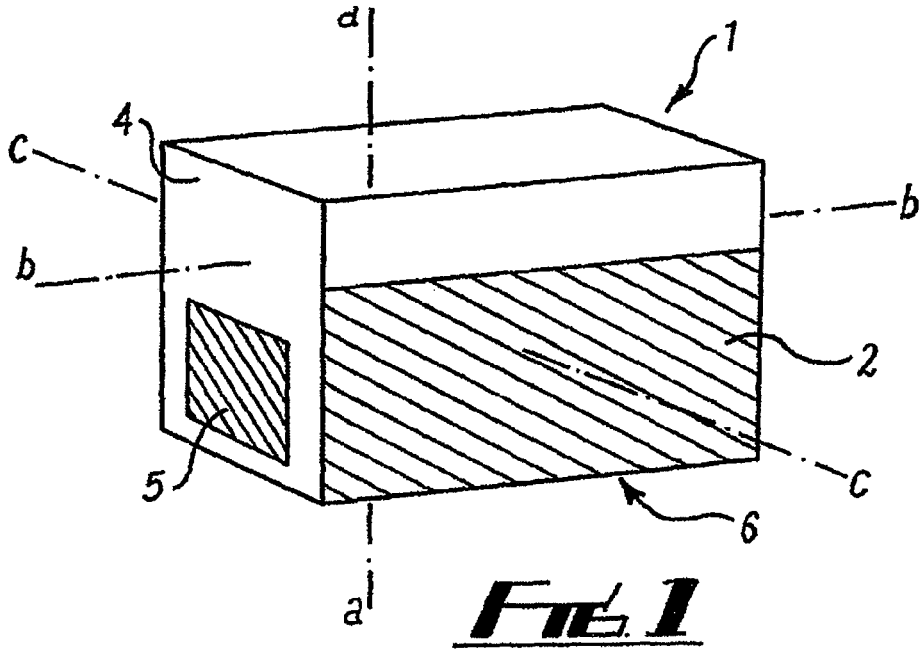
FIG. 1 is a perspective view of a loudspeaker unit according to the invention.
Figure 2:
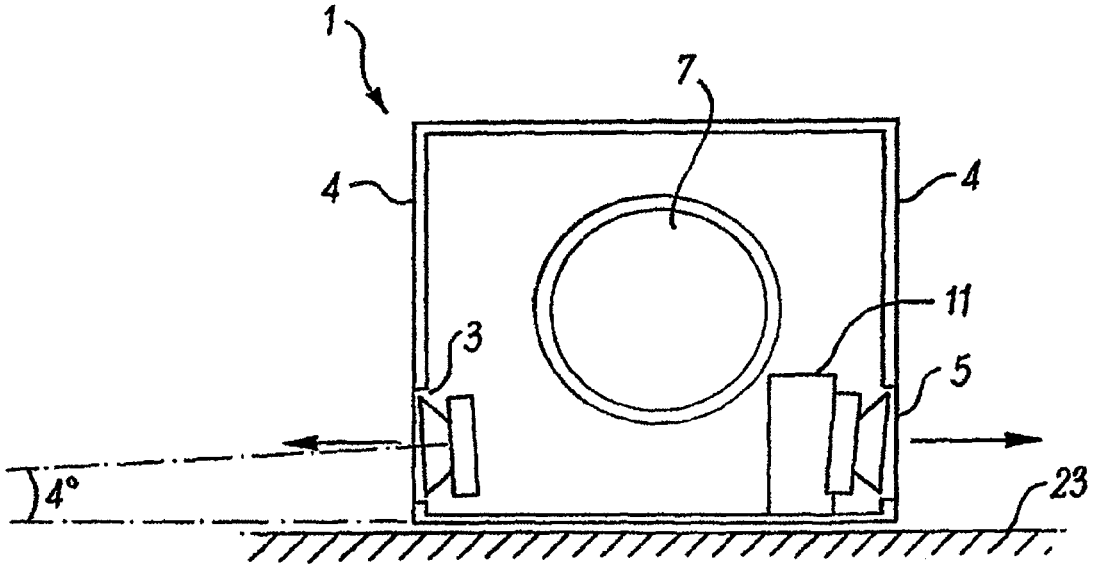
FIG. 2 is a cross-sectional view, taken along the plane of lines a-a and b-b of FIG. 1.
Figure 3:
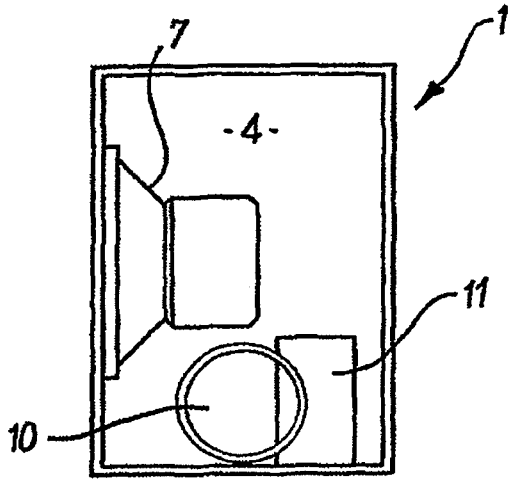
FIG. 3 is a cross-sectional view, taken along the plane of lines a-a and c-c of FIG. 1.

In the following, where the terms front, rear, top, bottom and like terms are used they refer to directions relative to the apparatus as illustrated and/or as it is intended to be used. The terms are used for convenience only and are not intended to be otherwise limiting.

Referring to the drawings, FIGS. 1 to 4 show a sum and difference loudspeaker unit according to the invention. The unit could incorporate means (not shown) for producing an audio signal, for example a tuner, such as a DAB tuner, a compact disc player or MP3 player.

The unit comprises a housing 1 which is, externally, generally cuboidal in shape. The housing is manufactured from hardboard, but could be manufactured from any other suitable material such as is usually employed for the manufacture of loudspeaker housings. A generally circular aperture (not shown) covered by a grille 2 or other cover essentially transparent to sound is formed in the front of the housing 1.

A respective generally circular aperture 3 is formed in each of the two opposite sidewalls 4 of the housing 1 and each covered by a grille 5, or other cover essentially transparent to sound. Each of these apertures is positioned approximately mid way along, and adjacent the lower edge of sidewall 4 in which it is formed.

A further generally circular aperture in provided towards the rear of the underside 6 of the housing 1. The underside of the housing is substantially flat enabling the housing to be supported by its underside on a substantially flat surface.

No apertures are formed in the top or rear of the housing.

A single loudspeaker 7 is mounted to the inside of the front of the unit to .611 the aperture formed in the front of the unit. The loudspeaker is of a conventional type and comprises a driver 8 arranged to drive a diaphragm 9 of generally frustroconical shape. The loudspeaker 7 is arranged to transmit an audio signal through the aperture in the front of the unit.

A single loudspeaker 10 is also mounted to the inside of each sidewall 4 of the unit, filling the aperture in the sidewall. Each loudspeaker 10 also comprises a driver 8 and a diaphragm 9 of generally frustroconical shape. Each loudspeaker 10 is mounted to the sidewall at an angle relative to the sidewall 4 such that the central axis of its diaphragm 9 (shown as a broken line) extends towards an extension of the plane of the underside 6 of the unit, as the axis extends away from the unit. Each loudspeaker 10 is mounted such that the central axis of its diaphragm 9 will intersect the extension of the plane of the underside of the unit at an angle of about 4 degrees. Thus, the respective axes of the diaphragms of the two speakers 10 mounted to the sidewalls 4 of the unit will intersect each other at an angle of about 172 degrees.

In an alternative arrangement each loudspeaker 10 could be mounted at a position close to, but spaced apart from the inside of the sidewall 4 of the housing 1.

A cardboard tube 11 is mounted to the inside of the underside 6 of the unit, over the aperture formed in the underside of the -unit and extending into the unit. The tube forms a port. The port and all three speakers share the same acoustic environment within the device.

Figure 4:
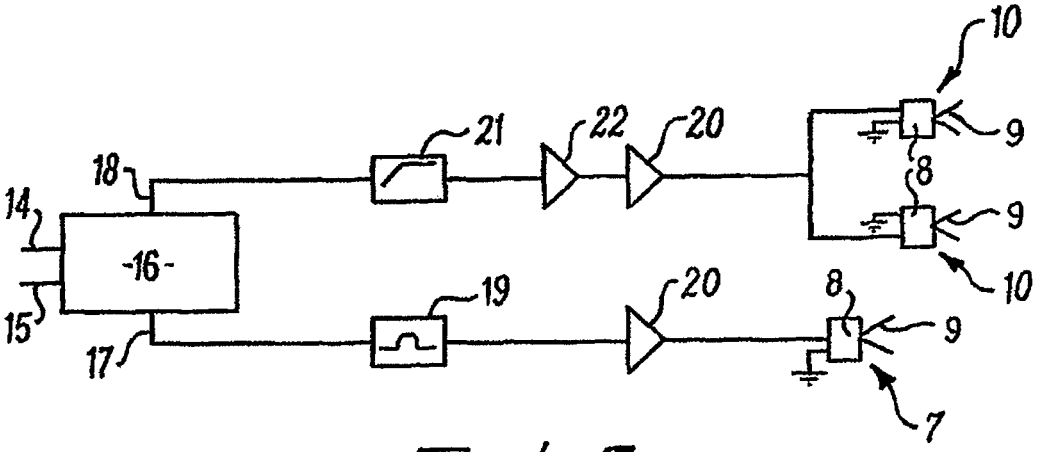
FIG. 4 is a block diagram of circuitry associated with the unit of FIG. 1.

The loudspeaker unit is associated with the electronic circuit shown in FIG. 4. It will be appreciated that the circuit components could be housed in the housing 1 or separately. The circuit components could be housed within the housing together with other components, specifically with components arranged to produce an audio signal, such as a tuner.

The circuit comprises two inputs 14, 15 connected to a sum and difference matrix 16. The sum and difference matrix 16 is arranged to produce two outputs: a sum output at 17 which comprises the sum of the inputs at 14 and 15 (14+15); and a difference output at 18 which comprises the difference of the inputs at 14 and 15 (14−15).

The sum output 18 is connected to a bass lift compensation circuit 19. This adds a gain of about 3 dB to low frequency components of the signal, typically frequencies between 40 and 500 Hz. The output of the bass lift compensation circuit is connected via a power amplifier 20 to the loudspeaker 7 mounted behind the aperture in the front of the unit ("the mono loudspeaker").

The difference output 18 is connected to a high pass filter 21 operative to reduce the amplitude of frequencies below 100 Hz by at least 3 dB. The filtered signal is then subjected to a gain make up of about 4 dB by an amplifier 22, the output of which is connected via a power amplifier 20 to the loudspeakers 10 behind the apertures 3 in the sides 4 of the unit ("the difference loudspeakers"). The output is connected to the two difference loudspeakers such that the signals they produce when driven by the difference signal are out of phase (i.e., in anti-phase).

The power amplifier 20 associated with the difference loudspeakers 10 need only have around 10 to 20% of the power output of that associated with the mono loudspeaker 7.

The loudspeaker unit is intended to reproduce a conventional two channel stereo sound signal using the sum and difference system. In use the unit is preferably placed on a flat surface 23 which extends around all sides of the unit. The two channels (left and right) of a stereo sound signal are then supplied to the two inputs 14 and 15 of the sum and different matrix 16 respectively. Listeners should ideally be located towards the front of the unit, but could be located behind the unit. Although the unit enables listeners to appreciate the depth and width effect of a stereo recording over a wide area this will best be detected at locations on or near an axis extending through the mono loudspeaker 7 (i.e., substantially normal to the front of the housing 1). The depth and width effect will be worst at or near locations lying on an axis extending through the duct difference loudspeakers 10 (i.e., substantially normal to the sides 4 of the housing 1).

The described loudspeaker unit conveys significant advantages over conventional sum and difference loudspeaker arrangements. The housing 1 defines a single acoustic enclosure which all the loudspeakers share. This simplifies manufacture, and without the need to divide up the interior of the housing to provide separate acoustic enclosures, provides more space in the housing for electronic and associated components. Maximizing use of space is important in the manufacture of compact equipment. Having the three loudspeakers -share the- same acoustic enclosure also enhances the necessary interaction between the output of the sum and difference speakers. The port formed by the cardboard tube 11 and its associated aperture acts as a pressure relief valve for low frequencies.

Positioning the difference speakers adjacent the lower edge of the sides of the housing enables the surface effect to be exploited when the housing is placed on a surface, such as a floor or the top of a piece of furniture. Locating the loudspeakers in this way exploits the surface effect. When a sound is reproduced in close proximity to a flat surface (ideally one of greater linear dimension than the wavelength of the lowest frequency within the sound) then reflections of the sound from the surface have the effect of reinforcing the sound across the surface. As such sound pressure levels away from the sound source reduce at a lower level than the theoretical inverse square law which applies in free air. In practice the acoustic level of the difference signal transmitted via difference speakers 10 is enhanced, by around 8 to 10 dB. This enhances the depth and width effect in the reproduced sound. Exploitation of the surface effect is further aided by the difference speakers being mounted at an angle so that they are directed slightly towards a surface on which the unit is placed. Another benefit of the angled disposition of the difference speakers 10 is that, because the speakers do not share a common axis, there is a reduced tendency for mid frequency standing waves to form within the housing. This is undesirable as it can impair the overall quality of sound reproduced by the unit. Yet another advantage is that the angling of the difference speakers gives an element of guidance to the main spatial sound images produced by the device.

Performance improvements are also obtained through-processing of the incoming sound signal. Reproduction of low frequency sounds by the difference loudspeakers 10 is relatively poor compared to that of the larger mono loudspeaker 7. This is due in part to the inherent reduced capacity of smaller loudspeakers to reproduce low frequencies, and also due to cancellation between the out of phase signals produced by the two speakers which is to be expected for low frequencies due to their inherently long wavelengths. Although the cancellation problem could be reduced by further separating the two difference loudspeakers the required separation is impractical. Instead, reproduction of low frequencies by the difference loudspeakers 10 is compensated for by boosting the amplitude of low frequencies in the sum signal driving the mono loudspeaker 7. This in turn enables low frequencies to be cut out of the difference signal by means of the high pass filter 21, improving the integrity of the audio difference signal.

Figure 5:
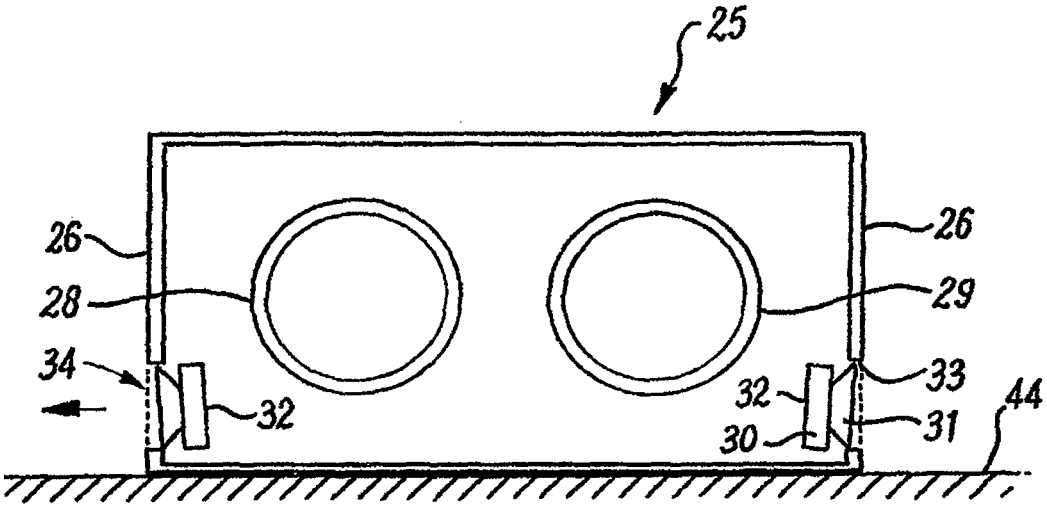
FIG. 5 is a cut away front view of another embodiment of a loudspeaker unit according to the invention.
Figure 6:
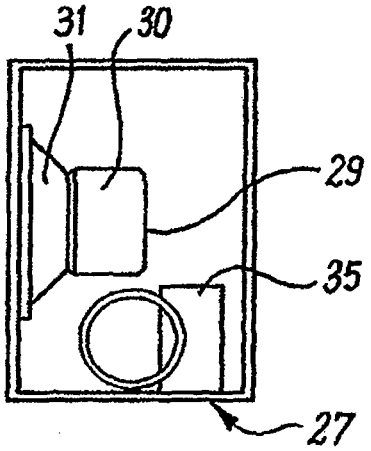
FIG. 6 is a-cut away side view of the embodiment of FIG. 5.
Figure 7:
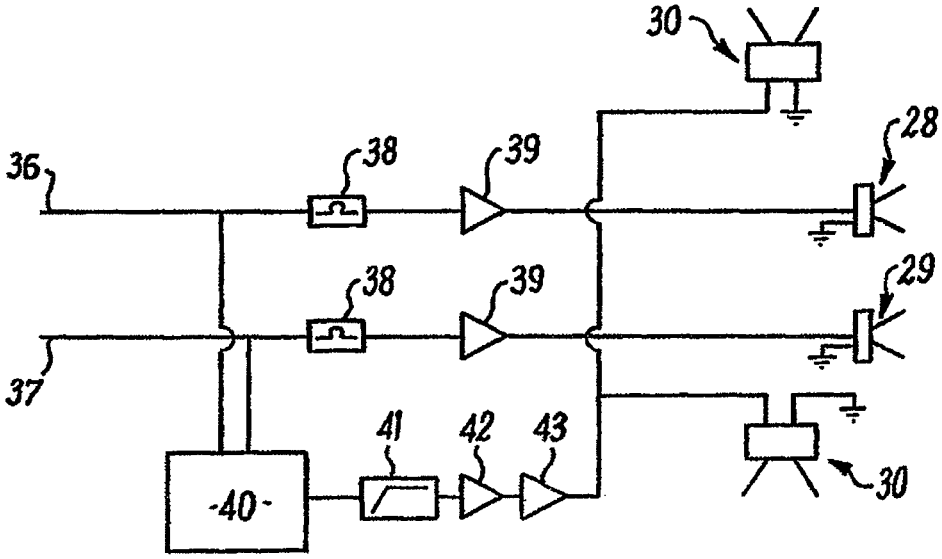
FIG. 7 is a block diagram of circuitry associated with the unit of FIG. 5.

FIGS. 5 to 7 show an alternative embodiment of a loudspeaker unit according to the invention. The unit is essentially similar to that shown in FIGS. 1 to 4, save that the single loudspeaker 10 arranged to broadcast a signal comprising the sum of two audio channels is replaced by two loudspeakers arranged to broadcast respective individual audio channels.

The embodiment of FIGS. 5 to 7 comprises a housing 25 which is, externally, generally cuboidal in shape. The housing is manufactured from hardboard, but could be manufactured from any other suitable material such as is usually employed for the manufacture of loudspeaker housings. Two generally circular apertures (not shown) covered by a grille or other cover essentially transparent to sound are formed in the front (not shown) of the housing 25. A respective, smaller, generally circular aperture 33 is formed in each of the two opposite sidewalls 26 of the housing 25 and each covered by a grille 34, or other cover essentially transparent to sound. Each of these apertures is positioned approximately mid way along, and adjacent the lower edge of sidewall 26 in which it is formed.

A further generally circular aperture is provided towards the rear of the underside 27 of the housing 25. The underside of the housing is substantially flat enabling the housing to be supported by its underside on a substantially flat surface.

No apertures are formed in the top or rear of the housing.

Loudspeakers 28, 29 are mounted to the inside of the front of the unit to fill the apertures formed in the front of the unit. The loudspeakers are of a conventional type and comprises a driver 30 arranged to drive a diaphragm 31 of generally frustroconical shape. The loudspeakers 28, 29 are arranged to transmit respective audio signals through the apertures in the front of the unit.

A single loudspeaker 32 is also mounted to the inside of each sidewall 26 of the unit, filling the aperture in the sidewall. Each loudspeaker 32 also comprises a driver 30 and a diaphragm 31 of generally frustroconical shape. Each loudspeaker 32 is mounted in the housing at an angle relative to the sidewall 26 such that the central axis of its diaphragm extends towards an extension of the plane of the underside 27 of the unit, as the axis extends away from the unit, in the same way as the unit shown in FIG. 2.

In an alternative arrangement each loudspeaker 10 could be mounted at a position close to, but spaced apart from the inside of the sidewall 4 of the housing 1.

A cardboard tube 35 is mounted to the inside of the underside 27 of the unit, over the aperture formed in the underside of the unit and extending into the unit. The tube forms a port. The port and all four loudspeakers share the same acoustic environment within the device. The port formed by the cardboard tube 35 and its associated aperture acts as a pressure relief valve for low frequencies.

The loudspeaker unit is associated with the electronic circuit shown in FIG. 7. It will be appreciated that the circuit components could be housed in the housing 26 or separately. The circuit components could be housed within the housing together with other components, specifically with components arranged to produce an audio signal, such as a tuner:

The circuit comprises two inputs 36, 37. These inputs are connected, respectively, to loudspeakers 28 and 29 via respective bass lift compensation circuits 38, and power amplifiers 39. The base lift compensation circuits 38 add a gain of about 3 dB to low frequency components of the signal, typically frequencies between 40 and 500 Hz.

The two circuit inputs 36 and 37 are also connected to a subtraction circuit 40, which outputs the difference of signals received at inputs 36 and 37. The difference output is connected to a high pass filter 41 operative to reduce the amplitude of frequencies below 100 Hz by at least 3 dB. The filtered signal is then subjected to a gain make up of about 4 dB by an amplifier 42, the output of which is connected via a power amplifier 43 to the loudspeakers 30 behind the apertures 3 in the sides 4 of the unit ("the difference loudspeakers"). The output is connected to the two difference loudspeakers such that the signals they produce when driven by the difference signal are out of phase (i.e., in anti-phase). More specifically; the difference speaker adjacent speaker 28 is driven by a signal comprising the signal received at input 36 less that received at input 37, and the other difference speaker (as a result of its reversed polarity) is effectively driven with a signal comprising the signal received at input 37 less that received at input 36.

The power amplifier 43 associated with the difference loudspeakers 10 need only have around 10 to 20% of the power output of those associated with the other loudspeakers 28, 29.

The loudspeaker unit is intended to reproduce a conventional two channel stereo sound signal exploiting some features of the sum and difference system. In use the unit is preferably placed on a flat surface 44 which extends around all sides of the unit. The two channels (right and left) of a stereo sound signal are then supplied to the two inputs 36 and 37 respectively. The two front speakers 28 and 29 will then output the left and right signals respectively, acting in the manner of a conventional two loudspeaker speaker stereo system. The two side speakers will output signals comprising left—right and right—left signals respectively, with the side speaker adjacent the front speaker which outputs the left signal outputting left-right and vice versa. Provision of the side speakers outputting difference signals enhances the depth and width available from the stereo signal, as compared to using the two front speakers alone. Listeners should ideally be located towards the front of the unit, but could be located behind the unit.

The described unit combines conventional two speaker stereo speaker technology with the aspects of sum and difference technology, resulting in a system which improves over both technologies. The invention also provides • a way in which conventional two speaker stereo units can be modified, by addition of difference speakers, to provide for enhanced reproduction of stereo signals. The improvement is significant for units where conventional left and right speakers are mounted close together. As compared to conventional sum and difference loudspeaker units the described loudspeaker unit conveys the same advantages as the first described embodiment over conventional sum and difference loudspeaker arrangements.

Figure 8:
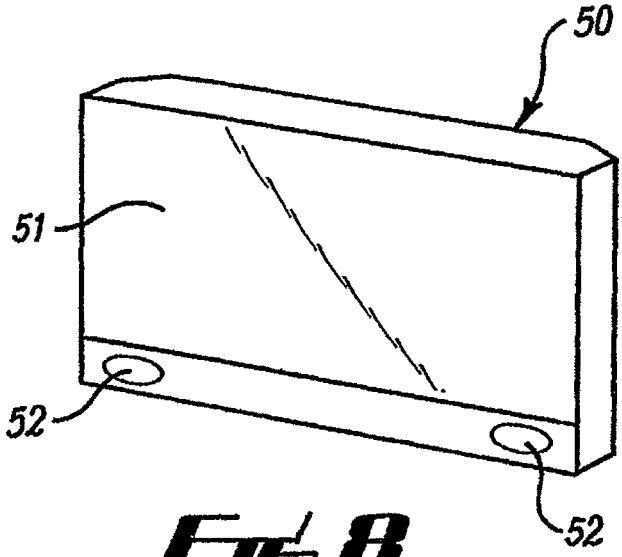
FIG. 8 is a schematic perspective schematic view of a television set incorporating a loudspeaker unit according to the invention.
Figure 9:
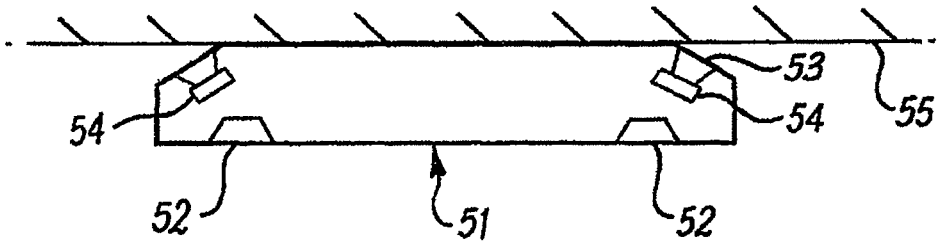
FIG. 9 is a cross-sectional view, from above, of the television set of FIG. 8 placed against a wall.

FIGS. 8 and 9 show how the arrangement of FIGS. 5 to 7 can be incorporated into a television set or monitor. The television set comprises a housing 50, mounted to the front of which is a screen 51. Also mounted to the front of the housing 50 are two spaced-apart loudspeakers 52. These speakers correspond to speakers 28 and 29 of the embodiment of FIGS. 5 to 7 and are arranged to broadcast the left and right channels of a conventional two channel stereo signal. At either side of the rear of the housing are panels 53 which extend at an angle of about 45° to the front of the housing. Mounted to these panels are respective speakers 54 which correspond to speakers 32 of the arrangement of FIGS. 5 to 7 and are arranged to broadcast respective out of phase signals consisting of the difference between the left and right audio channels of a conventional two channel audio signal. The rear of the television set is flat and generally parallel to the front. In use the rear of the set is intended to be placed adjacent a flat surface, typically the wall 55 of a room. As such, the speakers 54 towards the rear of the set are directed partially towards the wall, taking advantage of the surface effect.

The above embodiments are described by way of example only, many variations are possible without departing from the invention.

What is claimed is:

1. Apparatus for reproduction of stereo sound comprising:
a housing arranged to sit on a generally flat surface;
a first transducer arranged to reproduce one, or the sum, of two audio signals;
two transducers each arranged to reproduce a signal comprising the difference of the two audio signals; and
wherein the first transducer and the two transducers are all enclosed in the housing;
wherein the transducers arranged to reproduce the signal comprising the difference of the two audio signals are arranged to direct their outputs primarily along different axes and wherein each of said axes lies in a direction generally at right angles to the direction in which the first transducer is arranged to primarily direct its output; and
wherein the two transducers arranged to reproduce the signal comprising the difference of the two audio signals are arranged relative to the housing such that when the housing is placed on or adjacent a generally flat surface both transducers are oriented to direct their output primarily in a direction extending towards the plane of the surface.

2. Apparatus as claimed in claim 1 wherein the first transducer is arranged to reproduce one of the two audio signals and a second transducer is provided to reproduce the other signal, and the first and second transducers are arranged to direct their output in parallel, spaced apart directions.

3. Apparatus as claimed in claim 1 wherein each transducer is a loudspeaker.

4. Apparatus as claimed in claim 1 wherein the one or two transducers arranged to reproduce the signal comprising the difference of two audio signals is/are arranged to reproduce the signal out of phase with respect to each other, and to direct the two out of phase signals in different directions.

5. Apparatus as claimed in claim 1 wherein the housing has two openings via which signals comprising the difference of the two audio signals are transmitted.

6. Apparatus as claimed in claim 5 wherein the housing is arranged to be placed on or adjacent a generally flat surface, and the openings are disposed on the housing such that when the housing is placed on or adjacent a flat surface, the openings lie adjacent that surface.

7. Apparatus as claimed in claim 5 wherein the housing includes at least one flat surface.

8. Apparatus as claimed in claim 7 wherein the flat surface forms the underside and or a side of the housing.

9. Apparatus as claimed in claim 5 wherein the housing comprises a flat surface or surfaces extending from adjacent the or each opening.

10. Apparatus as clamed in claim 9 wherein the transducers arranged to reproduce a signal comprising the difference of the two audio signals are oriented to direct their output primarily in a direction extending towards the plane of the flat surface or surfaces extending from adjacent the or each opening at an angle of between 1 and 8 degrees to the surface.

11. Apparatus as claimed in claim 1 wherein the housing includes an opening via which a signal comprising the sum of the two audio signals is transmitted.

12. Apparatus as claimed in claim 11 wherein the housing includes an additional opening, forming a port which acts as a pressure relief valve to the at least partially enclosed space.

13. Apparatus as claimed in claim 12 wherein the port leads to a conduit or tube extending in the at least partial enclosure formed by the housing.

14. Apparatus as claimed in claim 12 wherein the housing is fully enclosed, save for provision of the port.

15. Apparatus as claimed in claim 1 wherein the housing includes one or two openings via which the two audio signals are separately transmitted.

16. Apparatus as claimed in claim 1, wherein the two transducers arranged to reproduce a signal comprising the difference of the two audio signals are oriented to direct their output in a direction extending at an angle of between 1 and 8 degrees to the plane of the surface.

17. Apparatus as claimed in claim 16 wherein the transducers are directed at an angle of between 2 and 6 degrees to the plane of the surface.

18. Apparatus as claimed in claim 16 wherein the transducers are directed at an angle of between 3 and 5 degrees to the plane of the surface.

19. Apparatus as claimed in claim 1 comprising a high pass filter arranged to reduce the amplitude of low frequencies in the difference of the two audio signals.

20. Apparatus as claimed in claim 1 comprising a bass lift compensation circuit operative to boost low frequencies.

21. Apparatus as claimed in claim 1 wherein the housing is arranged to receive a device intended to provide a stereo signal to drive the transducers.

22. Apparatus as claimed in claim 1 comprising means to produce a two channel stereo signal to drive the transducers.

23. Apparatus as claimed in claim 1 wherein the housing comprises a bottom panel, a top panel, a front panel, a back panel, a left side panel, a right side panel, a back left corner panel, and a back right corner panel, wherein:

the back left corner panel joins at an angle to both the left side panel and back panel;

the back right corner panel joins at the angle to both the right side panel and back panel;

the first transducer and second transducer are disposed on the front panel;

the one or two further transducers comprise a third transducer and a fourth transducer;

the third transducer is disposed on the back left corner panel; and the fourth transducer is disposed on the back right corner panel.

24. Apparatus as claimed in claim 23 wherein the angle is 45°.

* * * * *